US008864466B2

(12) United States Patent
Belmonte et al.

(10) Patent No.: US 8,864,466 B2
(45) Date of Patent: Oct. 21, 2014

(54) COOLING DEVICE FOR COOLING THE SLOTS OF A TURBOMACHINE ROTOR DISK DOWNSTREAM FROM THE DRIVE CONE

(75) Inventors: Olivier Belmonte, Perthes en Gatinais (FR); Stevan Le Goff, Vaux le Penil (FR); Paul Rodrigues, Savigny sur Orge (FR)

(73) Assignee: SNECMA, Paris (FR)

( * ) Notice: Subject to any disclaimer, the term of this patent is extended or adjusted under 35 U.S.C. 154(b) by 617 days.

(21) Appl. No.: 13/158,849

(22) Filed: Jun. 13, 2011

(65) Prior Publication Data

US 2011/0305560 A1 Dec. 15, 2011

(30) Foreign Application Priority Data

Jun. 14, 2010 (FR) ..... 10 54676

(51) Int. Cl.
*F01D 5/30* (2006.01)
*F01D 5/08* (2006.01)

(52) U.S. Cl.
CPC ..... *F01D 5/3015* (2013.01); *F01D 5/085* (2013.01); *F01D 5/3007* (2013.01); *F01D 5/082* (2013.01); *F01D 5/081* (2013.01); *F05B 2240/801* (2013.01)
USPC ..... 416/96 R

(58) Field of Classification Search
USPC ..... 415/115, 175, 176, 180; 416/95, 96 R, 416/204 A, 248, 219 R, 220 R
See application file for complete search history.

(56) References Cited

U.S. PATENT DOCUMENTS

| | | | | | |
|---|---|---|---|---|---|
| 3,635,586 | A | * | 1/1972 | Kent et al. | 416/97 R |
| 4,247,248 | A | * | 1/1981 | Chaplin et al. | 415/136 |
| 4,425,079 | A | * | 1/1984 | Speak et al. | 415/139 |
| 4,841,726 | A | * | 6/1989 | Burkhardt | 60/226.1 |
| 5,143,512 | A | * | 9/1992 | Corsmeier et al. | 415/115 |
| 5,288,210 | A | * | 2/1994 | Albrecht et al. | 416/198 A |
| 5,333,993 | A | * | 8/1994 | Stueber et al. | 415/174.5 |
| 5,472,313 | A | * | 12/1995 | Quinones et al. | 415/115 |

(Continued)

FOREIGN PATENT DOCUMENTS

WO WO 2005/052321 A1 6/2005

OTHER PUBLICATIONS

French Preliminary Search Report issued Jan. 24, 2011, in French 1054676, filed Jun. 14, 2010 (with English Translation of Category of Cited Documents).

*Primary Examiner* — Edward Look
*Assistant Examiner* — Eldon Brockman
(74) *Attorney, Agent, or Firm* — Oblon, Spivak, McClelland, Maier & Neustadt, L.L.P.

(57) ABSTRACT

A cooling device for cooling the slots of a turbomachine rotor disk is provided. The turbomachine includes an upstream rotor disk having a fastener flange with a periphery that is festooned; a downstream rotor disk; an endplate for holding blades and arranged around the ring of the downstream disk and co-operating therewith to form an air diffusion cavity; a cone for driving disks in rotation and having a fastener flange with a periphery that is festooned; and a plurality of bolted connections passing from upstream to downstream through the fastener flanges of the upstream disk and of the cone, the fastener flange of the endplate, and the fastener flange of the downstream disk. The fastener flange of the endplate is pierced by ventilation orifices opening out into the air diffusion cavity, the cavity opening out into the slots of the downstream disk at their upstream ends.

6 Claims, 2 Drawing Sheets

(56) References Cited

U.S. PATENT DOCUMENTS

| | | | | |
|---|---|---|---|---|
| 5,700,130 | A * | 12/1997 | Barbot et al. | 416/95 |
| 5,816,776 | A * | 10/1998 | Chambon et al. | 415/174.5 |
| 5,848,874 | A * | 12/1998 | Heumann et al. | 415/189 |
| 6,331,097 | B1 * | 12/2001 | Jendrix | 416/96 R |
| 6,361,277 | B1 * | 3/2002 | Bulman et al. | 416/96 R |
| 6,422,812 | B1 * | 7/2002 | Pepi et al. | 415/115 |
| 6,575,703 | B2 * | 6/2003 | Simeone et al. | 416/96 R |
| 6,960,060 | B2 * | 11/2005 | Lee | 415/115 |
| 7,390,170 | B2 * | 6/2008 | Charrier et al. | 416/198 R |
| 7,390,710 | B2 * | 6/2008 | Derderian et al. | 438/222 |
| 7,556,474 | B2 * | 7/2009 | Marchi | 415/115 |
| 7,926,289 | B2 * | 4/2011 | Lee et al. | 60/782 |
| 8,087,879 | B2 * | 1/2012 | Dejaune et al. | 415/115 |
| 8,092,152 | B2 * | 1/2012 | Dejaune et al. | 415/115 |
| 8,517,666 | B2 * | 8/2013 | Alvanos et al. | 415/115 |
| 2002/0028136 | A1 * | 3/2002 | Briesenick et al. | 415/116 |
| 2004/0179936 | A1 * | 9/2004 | Fitzgerald et al. | 415/116 |
| 2004/0191067 | A1 * | 9/2004 | Phipps et al. | 416/219 R |
| 2009/0004023 | A1 * | 1/2009 | Dejaune et al. | 416/97 R |
| 2009/0110561 | A1 * | 4/2009 | Ramerth et al. | 416/96 R |

* cited by examiner

COOLING DEVICE FOR COOLING THE SLOTS OF A TURBOMACHINE ROTOR DISK DOWNSTREAM FROM THE DRIVE CONE

BACKGROUND OF THE INVENTION

The present invention relates to the general field of cooling a turbomachine rotor disk that is located downstream from the cone for driving the disk in rotation. The invention relates more precisely to a device for cooling the slots in such a disk that have the blades mounted therein.

One of the fields of application of the invention is that of low-pressure turbines for aviation turbomachines of the bypass and two-spool type.

Each stage of the low-pressure turbine of a turbomachine is made up of a nozzle formed by a plurality of stationary vanes placed in a flow passage, and a rotary wheel placed behind of the nozzle and formed by a plurality of movable blades likewise placed in the flow passage and mounted via their roots in slots in a rotor disk. The rotor disks of the turbine are generally assembled to one another by means of rings that are fastened together by bolted connections passing through fastener flanges. The resulting disk assembly is itself connected to a turbine shaft via a cone in order to be driven in rotation.

In operation, the flow passage through the low-pressure turbine passes gas at a temperature that is very high. In order to avoid damaging the rotor disks and the blades mounted thereon, it is known to cool these parts by causing cool air to flow into the slots of the rotor disks. For this purpose, one of the known solutions consists in taking cooler air (for example from the high-pressure compressor of the turbomachine) and taking it via a cooling circuit to the slots of the rotor disks. For example, the air that is taken may be conveyed to the slots of the disks by passing via notches formed in the fastener flanges of the ring of the disk between the bolted connections. Reference may be made to document EP 2 009 235, which describes an example of such a cooling device.

Unfortunately, that type of cooling device is not applicable to all existing low-pressure turbines. In particular, it is not always possible to have recourse to a cooling device of the kind described above for cooling the disk that is situated directly downstream from the cone for driving the disks in rotation, because of leaks appearing at the fastener flanges.

OBJECT AND SUMMARY OF THE INVENTION

A main object of the present invention is thus to mitigate such drawbacks by proposing a device for cooling the slots of a rotor disk situated downstream from the rotary drive cone and that is applicable to any type of turbine.

This object is achieved by a cooling device for cooling the slots of a rotor disk in a turbomachine, the device comprising:

an upstream rotor disk centered on a longitudinal axis of a turbomachine and including an annular ring that extends downstream from a downstream main face of the disk, said ring having a fastener flange extending radially inwards with its periphery being festooned to have solid portions alternating with hollow portions;

a downstream rotor disk centered on the longitudinal axis of the turbomachine, having at its periphery a plurality of axial slots that are outwardly open and that are designed to receive the roots of respective blades, and an annular ring that extends upstream from an upstream main face of the disk, said ring having a fastener flange that extends radially inwards;

an annular endplate for holding the blades of the downstream disk, the endplate being arranged around the ring of the downstream disk and co-operating therewith to form an annular space defining an air diffusion cavity, said endplate including a fastener flange extending radially inwards;

an annular cone for driving disks in rotation, the cone being centered on the longitudinal axis of the turbomachine and including a fastener flange extending radially outwards with the periphery thereof being festooned to have solid portions alternating with hollow portions, the solid portions being angularly aligned with the solid portions of the fastener flange of the ring of the upstream disk; and a plurality of bolted connections passing from upstream to downstream successively through the solid portions of the fastener flanges of the ring of the upstream disk and of the cone, the fastener flange of the endplate, and the fastener flange of the ring of the downstream disk;

the fastener flange of the endplate being pierced by ventilation orifices opening out into the air diffusion cavity in order to feed it with cooling air, said air diffusion cavity opening out into the slots of the downstream disk via their upstream ends in order to cool them.

Such a cooling device is remarkable in that it makes it possible to ventilate the slots of the downstream disk without giving rise to leaks at the flanges fastening said downstream disk to the upstream disk. This results in an increase in the lifetime of the downstream disk.

The endplate may further include an annular ring extending upstream around the ring of the upstream disk and co-operating therewith to form an annular space communicating with the air diffusion cavity via ventilation orifices. Under such circumstances, the space formed between the respective rings of the endplate and of the upstream disk preferably communicates with an air feed cavity via the hollow portions of the fastener flanges of the ring of the upstream disk and of the cone. The ring of the endplate may be an interference fit on the ring of the upstream disk.

Preferably the endplate further includes radial sealing wipers for co-operating with the inside annular surface of a nozzle located between the upstream and downstream disks.

The invention also provides a low-pressure turbine stage for a turbomachine and a turbomachine, each including a cooling device as defined above.

BRIEF DESCRIPTION OF THE DRAWINGS

Other characteristics and advantages of the present invention appear from the following description made with reference to the accompanying drawings that show an embodiment having no limiting character. In the figures.

DETAILED DESCRIPTION OF AN EMBODIMENT

Figure 1:
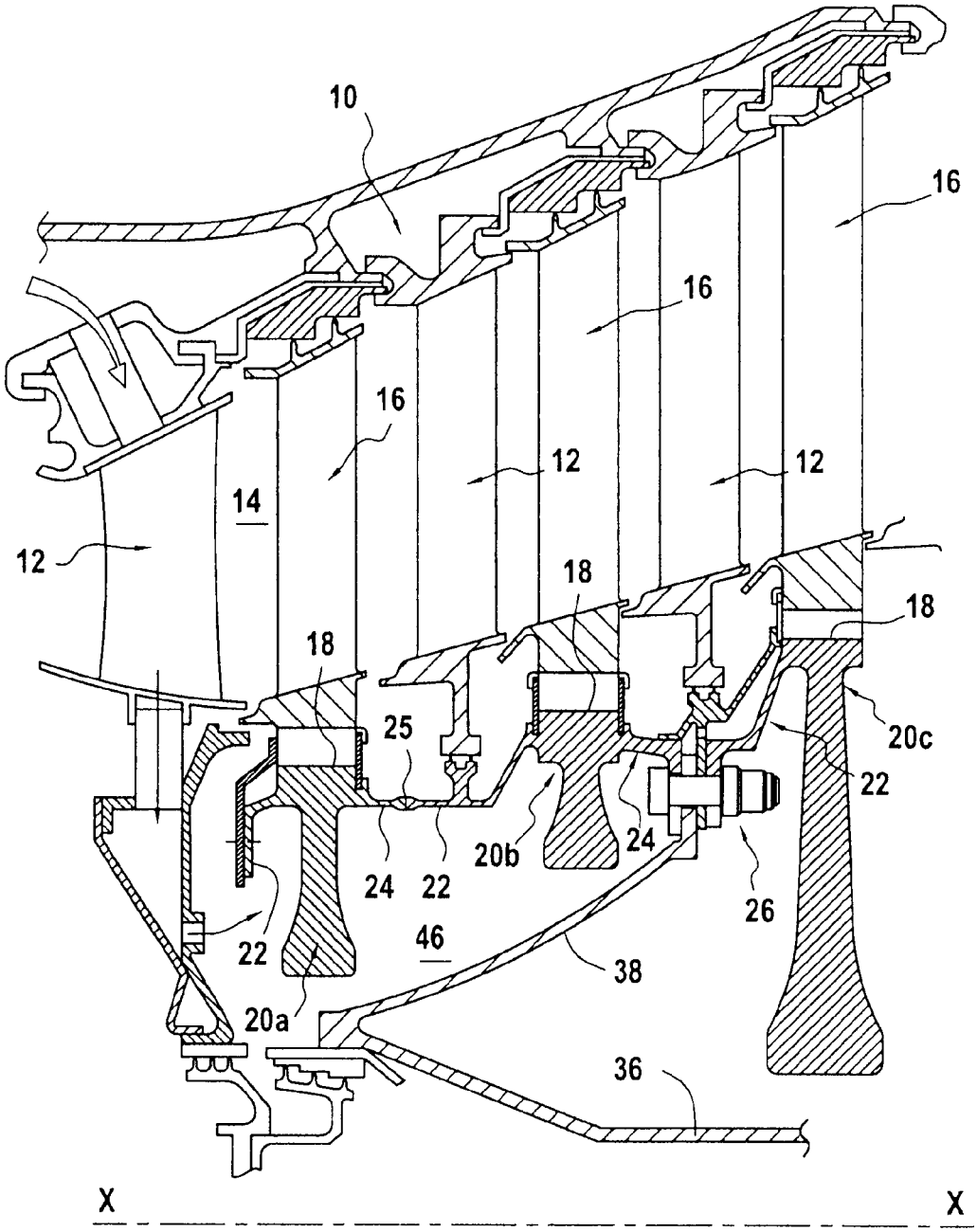
FIG. 1 is a longitudinal section view of a low-pressure turbine showing the location of the cooling device of the invention.

The invention is applicable to various types of rotary assembly in a turbomachine, and in particular to a low-pressure turbine in an aviation turbomachine of the bypass and two-spool type, such as that shown in part in FIG. 1.

The low-pressure turbine 10 comprises in particular a plurality of successive stages centered on a longitudinal axis X-X of the turbomachine (only the first three stages are shown in FIG. 1). Each of the stages comprises a nozzle formed by a plurality of stationary vanes 12 placed in a flow passage 14, and a rotary wheel placed behind the nozzle and made up of a plurality of movable blades 16, likewise placed in the flow passage 14 and having their roots mounted in slots 18 in a rotor disk 20*a*, 20*b*, and 20*c*.

The rotor disks 20*a*, 20*b*, and 20*c* of the low-pressure turbine are centered on the longitudinal axis X-X. Each of them has an upstream annular ring 22 that extends upstream from an upstream main face of the disk and a downstream annular ring 24 that extends downstream from a downstream main face of the disk. The disks are assembled together by means of the rings 22, 24.

More precisely, the disk 20*b* of the second stage of the turbine is connected to the disk 20*a* of the first stage by a weld bead 25 between the free ends of their respective upstream and downstream rings 22 and 24. Alternatively, these two disks could be assembled together by fabricating the disks and their rings as a single part. In another alternative, the two disks could be assembled together by means of bolted connections between their rings.

Figure 3:
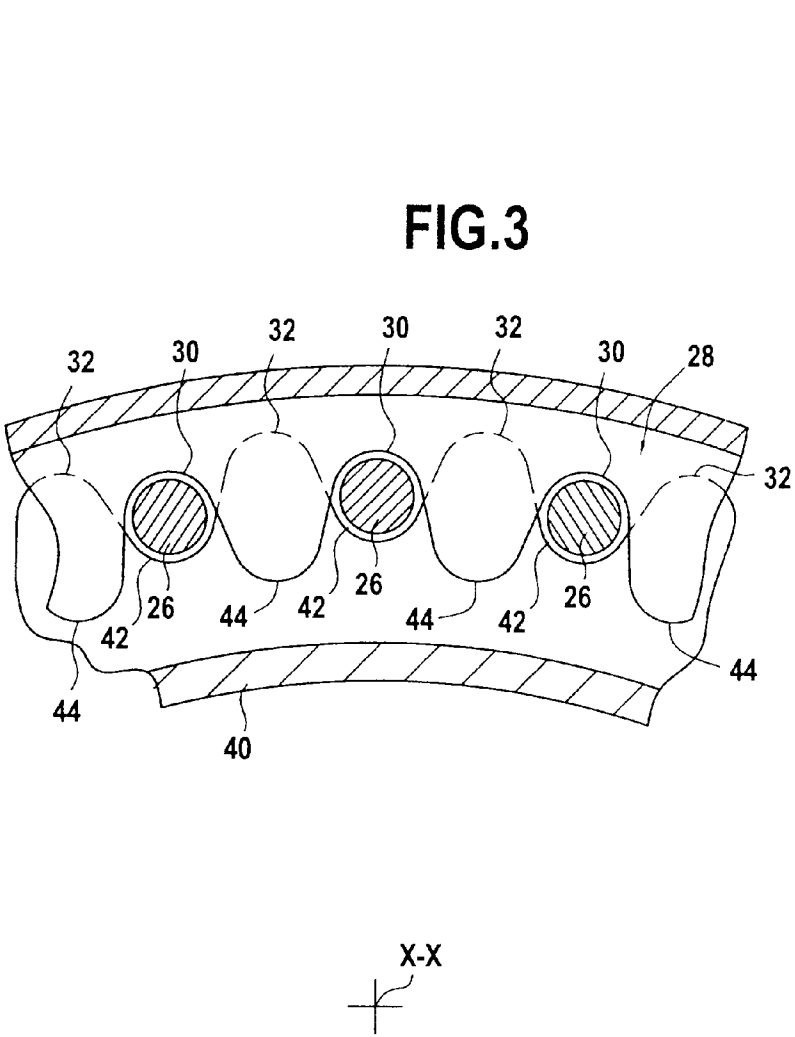
FIG. 3 is a section view on III-III of FIG. 2.
Figure 2:
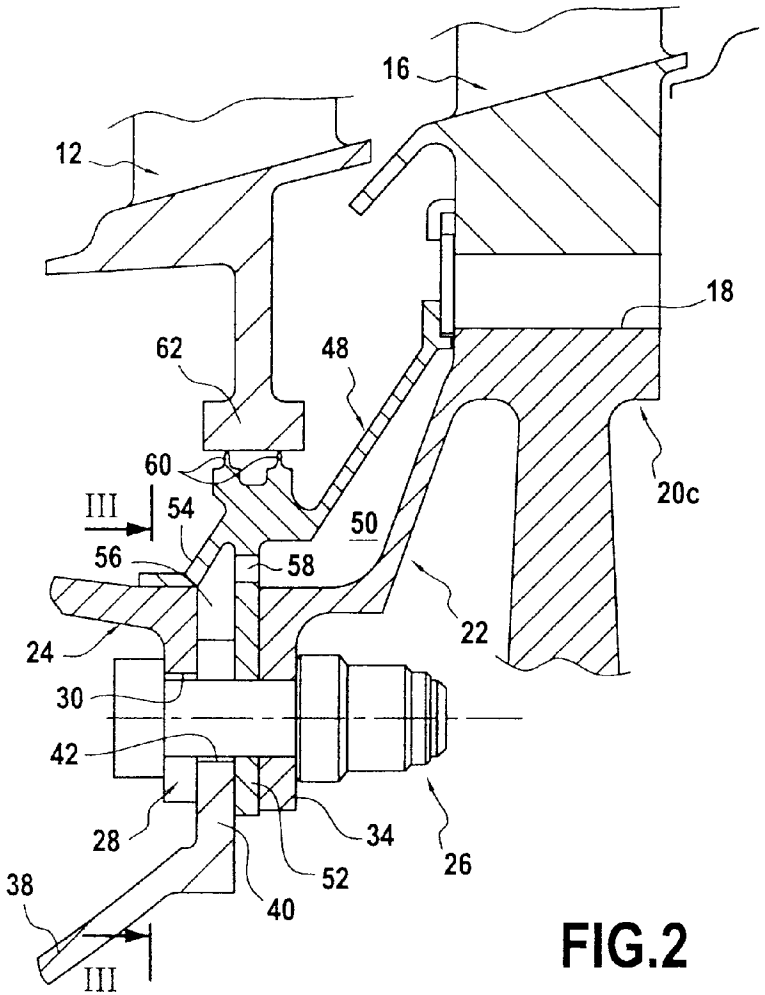
FIG. 2 is an enlarged view of the FIG. 1 cooling device.

The disk 20*c* of the third stage of the turbine is connected to the disk 20*b* of the second stage via two bolted connections 26 between their respective upstream and downstream rings. More precisely, and as shown in FIGS. 2 and 3, the downstream ring 24 of the disk of the second stage of the turbine has a fastener flange 28 extending radially inwards (i.e. towards the longitudinal axis X-X), with its periphery being festooned to have solid portions 30 alternating with a hollow portions 32. The solid portions 30 of the fastener flange have the bolted connections 26 passing therethrough. The upstream ring 22 of the disk 20*c* of the third stage likewise has a fastener flange 34 extending radially inwards (the free end of this flange however is not festooned, but it likewise has the bolted connections 26 passing therethrough).

The low-pressure turbine also includes a rotor shaft 36 centered on a longitudinal axis X-X and housed inside the rotor disks 20*a* to 20*c*. This rotor shaft is also connected to the assembled disks by means of an annular cone 38 so as to drive them in rotation.

The cone 38 for driving the disks in rotation is centered on the longitudinal axis X-X and includes a fastener flange 40 extending radially outwards (i.e. away from the axis X-X), and it has its periphery festooned with solid portions 42 alternating with hollow portions 44, the solid portions having the bolted connections 26 passing therethrough. Furthermore, as shown more particularly in FIG. 3, the solid portions 42 are angularly in alignment with the solid portions 30 of the fastener flange 28 of the downstream ring of the disk of the second stage of the turbine (the same applies to the respective hollow portions of these two fastener flanges).

In known manner, cool air is taken from the flow passage of the gas stream passing through the turbomachine at a point that is upstream from the low-pressure turbine, e.g. from a stage of the high-pressure compressor (not shown) thereof. This air travels to an annular cavity 46 formed inside the disks of the rotor and defined axially in the downstream direction by the cone 38 for driving the disks in rotation.

This air is for ventilating the slots of the disks in the various stages of the turbine in order to cool them. FIG. 2 shows more precisely how this air serves to ventilate the slots 18 of the disk 20*c* of the rotor that forms part of the third stage of the turbine.

An annular endplate 48 for holding the blades centered on the longitudinal axis X-X is placed around the upstream ring 22 of the disk 20*c* of the third stage of the turbine, co-operating therewith to form an annular space 50 that constitutes an air-diffusion cavity. This air diffusion cavity opens out downstream into the slots 18 of the disk 20*c* at their upstream ends in order to ventilate them.

The endplate 48 for holding the blades includes a fastener flange 52 that extends radially inwards (with its periphery not being festooned). It also includes an annular ring 54 that extends upstream around the downstream ring 24 of the disk 20*b* of the second stage of the turbine (on which it is an interference fit) co-operating therewith to form an annular space 56 communicating with the air diffusion cavity 50 via ventilation orifices 58 pierced through its fastener flange 52.

Thus, the cool air present in the annular cavity 46 formed inside the disks feeds the space 56 formed between the ring of the endplate and the downstream ring of the disk 20*b*, by flowing radially via the respective hollow portions in the fastener flanges of the downstream ring 24 of the disk 20*b* and of the cone 38 for driving the disks in rotation. This air then flows into the air diffusion cavity 50 by passing through the ventilation orifices 58, and then diffuses into each of the slots 18 of the disk 20*c* in order to ventilate them.

Furthermore, as mentioned above, the bolted connections 26 serve firstly to assemble together the disks 20*b* and 20*c* of the second and third stages of the turbine, and secondly to connect the disks to the cone 38. The various above-mentioned elements of the turbine are arranged in such a manner that these bolted connections 26 pass from upstream to downstream successively through: the solid portions 30 of the fastener flange 28 of the downstream ring 24 of the disk 20*b*; the solid portions 42 of the fastener flange 40 of the cone 38 for driving the disks in rotation; the fastener flange 52 of the endplate 48; and the fastener flange 34 of the upstream ring 22 of the disk 20*c*.

Advantageously, the endplate 48 for holding the blades also includes radial sealing wipers 60 that co-operate in operation with the inside annular surface 62 of the nozzle of the third stage of the turbine (and thus located between the disks 20*b* and 20*c*).

What is claimed is:

1. A cooling device for cooling the slots of a rotor disk in a turbomachine, the device comprising:

an upstream rotor disk centered on a longitudinal axis of a turbomachine and including an annular ring that extends downstream from a downstream main face of the disk, said ring having a fastener flange extending radially inwards with a periphery thereof being festooned to have solid portions alternating with hollow portions;

a downstream rotor disk centered on the longitudinal axis of the turbomachine, having at a periphery thereof a plurality of axial slots that are outwardly open and that are designed to receive the roots of respective blades, and an annular ring that extends upstream from an upstream main face of the disk, said ring having a fastener flange that extends radially inwards;

an annular endplate for holding the blades of the downstream disk, the endplate being arranged around the ring of the downstream disk and co-operating therewith to form an annular space defining an air diffusion cavity, said endplate including a fastener flange extending radially inwards;

an annular cone for driving disks in rotation, the cone being centered on the longitudinal axis of the turbomachine and including a fastener flange extending radially outwards with a periphery thereof being festooned to have solid portions alternating with hollow portions, the solid portions being angularly aligned with the solid portions of the fastener flange of the ring of the upstream disk; and a plurality of bolted connections passing from upstream to downstream successively through the solid portions of the fastener flange of the ring of the upstream disk, the solid portions of the fastener flange of the cone, the fastener flange of the endplate, and the fastener flange of the ring of the downstream disk, wherein the fastener flange of the endplate is pierced by ventilation orifices opening out into the air diffusion cavity in order to feed the air diffusion cavity with cooling air, said air diffusion cavity opening out into the slots of the downstream disk via their upstream ends in order to cool the slots of the downstream disk, and wherein the endplate further includes an annular ring extending upstream around the ring of the upstream disk and co-operating therewith to form an annular space communicating with the air diffusion cavity via ventilation orifices.

2. The device according to claim 1, wherein the space formed between the respective rings of the endplate and of the upstream disk communicates with an air feed cavity via the hollow portions of the fastener flanges of the ring of the upstream disk and of the cone.

3. The device according to claim 1, wherein the ring of the endplate is an interference fit on the ring of the upstream disk.

4. The device according to claim 1, wherein the endplate further includes radial sealing wipers for co-operating with the inside annular surface of a nozzle located between the upstream and downstream disks.

5. A low-pressure turbine stage of a turbomachine including a cooling device according to claim 1.

6. A turbomachine including a cooling device according to claim 1.

* * * * *